US011882946B2

(12) United States Patent
Zhang et al.

(10) Patent No.: US 11,882,946 B2
(45) Date of Patent: Jan. 30, 2024

(54) CHILD ACCOMMODATING APPARATUS WITH AN ARMREST ROTATING MECHANISM

(71) Applicant: Bambino Prezioso Switzerland AG, Steinhausen (CH)

(72) Inventors: Da Liang Zhang, Guangdong (CN); Ganqing Fang, Guangdong (CN)

(73) Assignee: Bambino Prezioso Switzerland AG, Steinhausen (CH)

( * ) Notice: Subject to any disclaimer, the term of this patent is extended or adjusted under 35 U.S.C. 154(b) by 0 days.

(21) Appl. No.: 17/585,486

(22) Filed: Jan. 26, 2022

(65) Prior Publication Data

US 2022/0142377 A1 May 12, 2022

Related U.S. Application Data

(63) Continuation of application No. 16/145,215, filed on Sep. 28, 2018, now Pat. No. 11,259,651.

(30) Foreign Application Priority Data

Sep. 30, 2017 (CN) ..... 201710939284.4

(51) Int. Cl.
*A47D 9/00* (2006.01)
*A47C 7/54* (2006.01)
(Continued)

(52) U.S. Cl.
CPC ..... *A47D 9/005* (2013.01); *A47C 7/543* (2013.01); *A47D 9/012* (2022.08); *A47D 13/06* (2013.01); *A47D 15/00* (2013.01)

(58) Field of Classification Search
CPC ..... A47D 15/00; A47D 15/008; A47D 9/00; A47D 13/06; A47D 13/061; A47D 13/063;
(Continued)

(56) References Cited

U.S. PATENT DOCUMENTS 3,825,218 A * 7/1974 Krumbein ..... G03B 21/10 403/81
5,911,653 A * 6/1999 Cheng ..... A47D 13/063 5/99.1

(Continued)

*Primary Examiner* — Justin C Mikowski
*Assistant Examiner* — George Sun
(74) *Attorney, Agent, or Firm* — Winston Hsu

(57) ABSTRACT

A child accommodating apparatus is provided and includes a frame, an armrest tube and an armrest rotating mechanism. The armrest tube is rotatably connected with the frame. The armrest rotating mechanism is for rotating the armrest tube. The armrest rotating mechanism includes an engagement device and an operation device. The engagement device is disposed between the armrest tube and the frame and for positioning the armrest tube relative to the frame. The operation device is disposed on the armrest tube and connected with the engagement device. The operation device utilizes a movement of a housing or a movement of a button body to disengage the armrest tube from the frame, which enables the armrest tube to be adjusted relative to the frame between a lifted using configuration and a lowered access configuration. The child accommodating apparatus has advantages of simple structure, reliable locking design, and easy unlocking design.

17 Claims, 14 Drawing Sheets

(51) Int. Cl.
*A47D 13/06* (2006.01)
*A47D 15/00* (2006.01)

(58) Field of Classification Search
CPC .. A47D 13/065; A47D 13/066; A47D 13/068; A47D 11/007; A47D 9/005; A47D 9/012; A47C 7/543
See application file for complete search history.

(56) References Cited

U.S. PATENT DOCUMENTS 6,082,922 A * 7/2000 Cheng ..... A47D 13/063 403/92
8,458,831 B2 6/2013 Flannery
2005/0262632 A1* 12/2005 Wu ..... A61G 7/051 5/426
2007/0204400 A1* 9/2007 Yang ..... A47D 13/063 5/99.1
2011/0085847 A1* 4/2011 Anderson ..... A47D 13/063 403/81
2012/0084916 A1* 4/2012 Flannery ..... A47D 15/00 5/426
2015/0196135 A1* 7/2015 Longenecker ..... A47D 13/063 403/53
2015/0296999 A1* 10/2015 Fiore, III ..... A47D 13/063 5/655
2016/0106226 A1* 4/2016 Yi ..... A47D 9/00 5/11
2016/0198864 A1* 7/2016 Yang ..... A47D 9/012 5/655
2016/0270556 A1* 9/2016 Sack ..... A47D 5/00
2016/0286979 A1* 10/2016 Sclare ..... A47D 9/00
2017/0238721 A1* 8/2017 Damiani ..... A47D 15/008
2017/0251828 A1* 9/2017 Kapanzhi ..... A47D 9/005

* cited by examiner

CHILD ACCOMMODATING APPARATUS WITH AN ARMREST ROTATING MECHANISM

CROSS REFERENCE TO RELATED APPLICATIONS

This application is a continuation application of U.S. application Ser. No. 16/145,215, filed on Sep. 28, 2018, which claims the benefit of China Patent Application No. 201710939284.4, filed on Sep. 30, 2017. The content of the application is incorporated herein by reference.

BACKGROUND OF THE INVENTION

1. Field of the Invention

The invention relates to a child accommodating apparatus, and more particularly, to a child accommodating apparatus with an armrest rotating mechanism.

2. Description of the Prior Art

General child accommodating apparatus, such as an infant child stroller, a cradle, a cradle bed, a child seat, a high chair, a bedside crib, a play yard, etc., is configured with an conventional armrest. Generally, the conventional armrest can be fixed on a frame of the child accommodating apparatus, detachably installed on the frame so that the armrest can be separated from the child accommodating apparatus when required, or foldably mounted to the frame so that the child accommodating apparatus can be folded for achieving reduced storage volume. As for the armrest of the child accommodating apparatus with foldability, a rotating device is often disposed in the armrest.

However, conventional armrests do not meet the requirements of utilization convenience. When taking care of an infant/child, a caregiver needs to hold the infant/child out of or into the child accommodating apparatus frequently. As for the conventional armrest fixed on or detachably installed on the frame, the configuration of the armrest is nonadjustable, which is inconvenient for holding the infant/child into or out of the child accommodating apparatus. An armrest foldably mounted to the frame also has the abovementioned problems.

Therefore, it is important to provide an armrest rotating mechanism with a simple structure, a reliable locking design, an easy unlocking design, and adjustability for the conventional armrest.

SUMMARY OF THE INVENTION

Therefore, it is an objective of the present application to provide a child accommodating apparatus with an armrest rotating mechanism which has a simple structure and an easy operation, so as to make an armrest adjustable relative to a frame of the child accommodating apparatus.

In order to achieve the aforementioned objective, the present invention discloses a child accommodating apparatus. The child accommodating apparatus includes a frame, an armrest tube and an armrest rotating mechanism. The armrest tube is rotatably connected with the frame. The armrest rotating mechanism is for rotating the armrest tube. The armrest rotating mechanism includes an engagement device and an operation device. The engagement device is disposed between the armrest tube and the frame and for positioning the armrest tube relative to the frame. The operation device is disposed on the armrest tube and connected with the engagement device. The operation device includes a housing, a driving groove and an inserting pin. The housing is rotatably installed on the armrest tube and rotatable relative to the armrest. The driving groove is disposed on the housing. The inserting pin is engaged with the driving groove and coupled to the engagement device. The housing of the operation device is operated to rotate relative to the armrest tube to drive the inserting pin to drive the engagement device to disengage the armrest tube from the frame.

According to an embodiment of the present invention, the engagement device includes a fixing holder, an engaging pin and a transmission member. The fixing holder is fixed on the frame. A positioning groove is formed on the fixing holder, and the armrest tube is pivoted to the fixing holder. The engaging pin is engaged with the positioning groove. The transmission member is connected to the engaging pin and the inserting pin of the operation device. The housing of the operation device is operated to rotate relative to the armrest tube to drive the inserting pin to drive the transmission member to disengage the engaging pin from the positioning groove.

According to an embodiment of the present invention, the engagement device further includes a sliding member and a resilient member. The sliding member is fixed on the engaging pin. The resilient member is disposed between the armrest tube and the sliding member. The transmission member is connected to the sliding member and the inserting pin of the operation device.

According to an embodiment of the present invention, the positioning groove includes a groove portion and a plurality of restraining portions. The plurality of restraining portions are positioned at two terminal ends of the groove portion. The engaging pin is configured to move in the groove portion and to be restrained at one of the plurality of restraining portions.

According to an embodiment of the present invention, the engagement device further includes a restoring member installed on the fixing holder. An end of the restoring member abuts against the fixing holder, and another end of the restoring member abuts against the armrest tube.

According to an embodiment of the present invention, an end of the inserting pin abuts against the driving groove.

According to an embodiment of the present invention, an extension direction of the driving groove is inclined relative to a horizontal direction, and an extension direction of the inserting pin is substantially perpendicular to a plane whereon the driving groove is located.

According to an embodiment of the present invention, the operation device further includes a button body, a locking pin and a positioning hole. The button body is left and right movably accommodated in the housing and partially exposed outside the housing. The locking pin is connected with the button body. The positioning hole is positioned on a side of the housing. The locking pin is configured to protrude out of the housing so as to engage with the positioning hole.

According to an embodiment of the present invention, the child accommodating apparatus further includes a leaf spring installed inside the button body.

In order to achieve the aforementioned objective, the present invention further discloses a child accommodating apparatus. The child accommodating apparatus includes a frame, an armrest tube and an armrest rotating mechanism. The armrest tube is rotatably connected with the frame. The armrest rotating mechanism is for rotating the armrest tube.

The armrest rotating mechanism includes an engagement device and an operation device. The engagement device is disposed between the armrest tube and the frame and for positioning the armrest tube relative to the frame. The operation device is disposed on the armrest tube and connected with the engagement device. The operation device includes a housing, a button body and an inserting pin. The housing is fixed on the armrest tube. The button body is up and down movably installed on the housing and the armrest tube. The inserting pin is selectively engaged with the button body and coupled to the engagement device. A moving direction of button body is different from a moving direction of the inserting pin. The button body of the operation device is operated to move relative to the armrest tube to drive the inserting pin to drive the engagement device to disengage the armrest tube from the frame.

According to an embodiment of the present invention, the engagement device includes a fixing holder, an engaging pin and a transmission member. The fixing holder is fixed on the frame. A positioning groove is formed on the fixing holder, and the armrest tube is pivoted to the fixing holder. The engaging pin is engaged with the positioning groove. The transmission member is connected to the engaging pin and the inserting pin of the operation device. The button body of the operation device is operated to move relative to the armrest tube to drive the inserting pin to drive the transmission member to disengage the engaging pin from the positioning groove.

According to an embodiment of the present invention, the engagement device further includes a sliding member and a resilient member. The sliding member is fixed on the engaging pin. The resilient member is disposed between the armrest tube and the sliding member. The transmission member is connected to the sliding member and the inserting pin of the operation device.

According to an embodiment of the present invention, the positioning groove includes a groove portion and a plurality of restraining portions. The plurality of restraining portions are positioned at two terminal ends of the groove portion. The engaging pin is configured to move in the groove portion and to be restrained at one of the plurality of restraining portions.

According to an embodiment of the present invention, the engagement device further includes a restoring member installed on the fixing holder. An end of the restoring member abuts against the fixing holder, and another end of the restoring member abuts against the armrest tube.

According to an embodiment of the present invention, a sliding groove is formed on the armrest tube, and the inserting pin is movably disposed in the sliding groove.

According to an embodiment of the present invention, an inclined surface interfering with the inserting pin is disposed on the button body. The inclined surface is inclined relative to the moving direction of the button body and the moving direction of the inserting pin. A restraining groove is positioned at a terminal end of the inclined surface, and the inserting pin is configured to move along an unlocking direction relative to the inclined surface towards the restraining groove so as to be inserted into the restraining groove for achieving an unlocking status.

According to an embodiment of the present invention, the button body includes an operation portion exposed outside the housing and for pulling the button body along a locking direction.

In contrast to the prior art, the armrest rotating mechanism of the present invention is suitable for the child accommodating apparatus with an armrest. By operating the operation device on the child accommodating apparatus to drive the engagement device so as to shift the engagement configuration of the engagement device, the armrest tube can be disengaged from the frame of the child accommodating apparatus, which enables the armrest tube to be adjusted relative to the frame. That is, the armrest tube can be rotated to another configuration that provides utility convenience. In addition, the armrest rotating mechanism has a simple structure, a reliable locking design, and an easy unlocking design and can be applied to various fields.

These and other objectives of the present invention will no doubt become obvious to those of ordinary skill in the art after reading the following detailed description of the preferred embodiment that is illustrated in the various figures and drawings.

DETAILED DESCRIPTION

Certain terms are used throughout the following description and claims to refer to particular system components. As one skilled in the art will appreciate, manufacturers may refer to a component by different names. In the following discussion and claims, the system components are differentiated not by their names but by their function and structure differences. In the following discussion and claims, the terms "include" and "comprise" are used in an open-ended fashion and should be interpreted as "include but is not limited to". Also, the term "couple" or "link" is intended to mean either an indirect or a direct mechanical or electrical connection. Thus, if a first device is coupled or linked to a second device, that connection may be through a direct mechanical or electrical connection, or through an indirect mechanical or electrical connection via other devices and connections.

An armrest rotating mechanism of the present application can be applied to various child accommodating apparatuses with an armrest device, such as an infant child stroller, a cradle, a cradle bed, a child seat, a high chair, a bedside crib, a play yard, etc., and not limited to this. In the following paragraphs, a cradle bed is taken as an example for illustrating the present application, but not limited to this.

Figure 1:
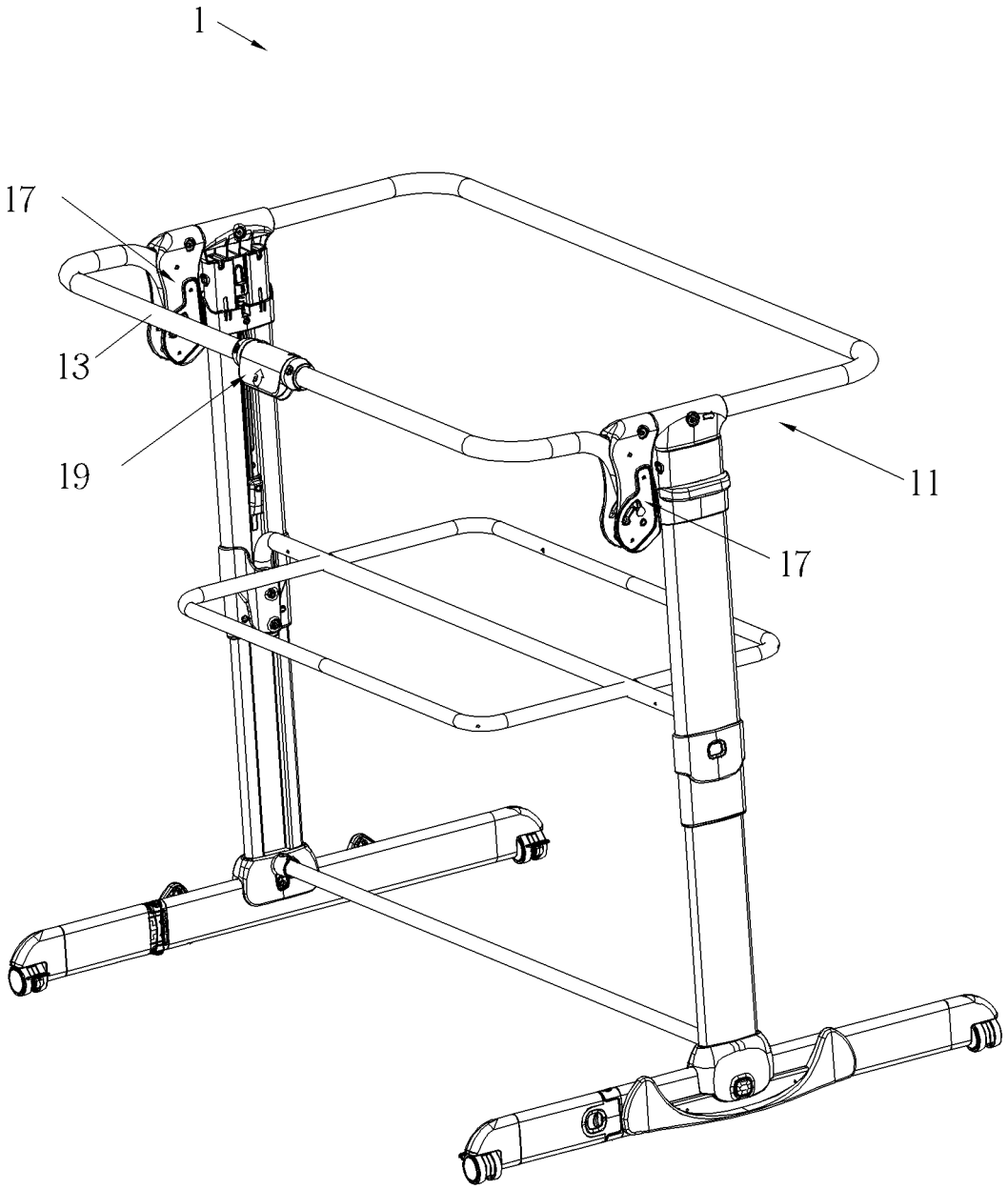
FIG. 1 is a diagram of a child accommodating apparatus at a using configuration according to a first embodiment of the present application.
Figure 2:
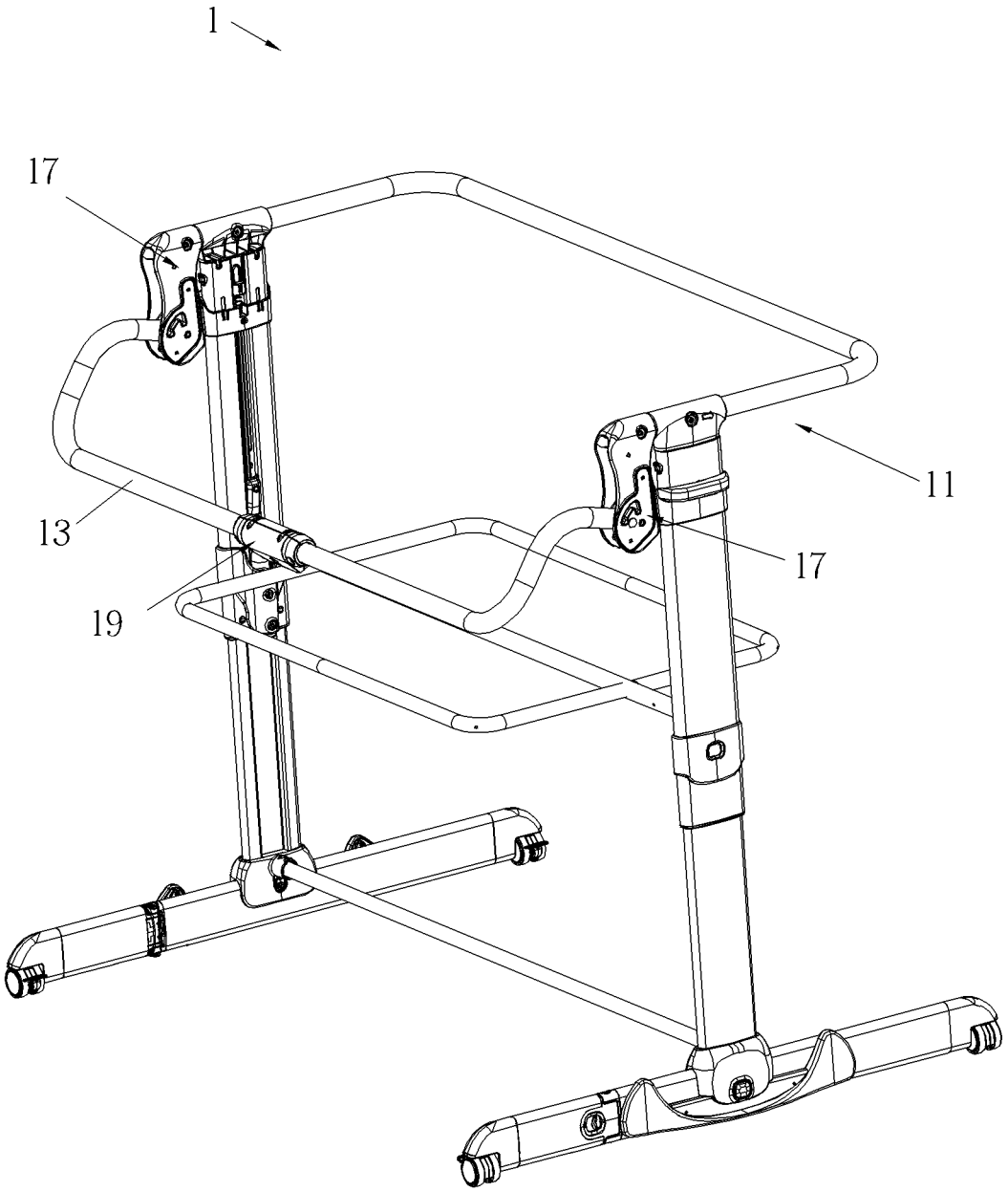
FIG. 2 is a diagram of the child accommodating apparatus at an access configuration according to the first embodiment of the present application.

Please refer to FIG. 1 and FIG. 2. FIG. 1 is a diagram of a child accommodating apparatus 1 at a using configuration according to a first embodiment of the present application. FIG. 2 is a diagram of the child accommodating apparatus 1 at an access configuration according to the first embodiment of the present application. The child accommodating apparatus 1 includes a frame 11, an armrest tube 13 rotatably connected with the frame 11, and an armrest rotating mechanism for controlling rotation of the armrest tube 13. The armrest rotating mechanism enables the armrest tube 13 to shift (or to rotate) between different configurations relative to the frame 11. For example, the armrest tube 13 can be rotated from a lifted using configuration, as shown in FIG. 1, to a lowered access configuration opened for easy access to an infant/child in the child accommodating apparatus 1, as shown in FIG. 2, and then the armrest tube 13 can be settled at the access configuration. According to the embodiment of the present application, the frame 11 is a frame for a cradle bed installed thereto, and the armrest tube 13 is disposed in front of and above the cradle bed. In other applications, the frame can be a main frame body of a device, such as a crib frame, a stroller frame, etc.

Figure 3A:
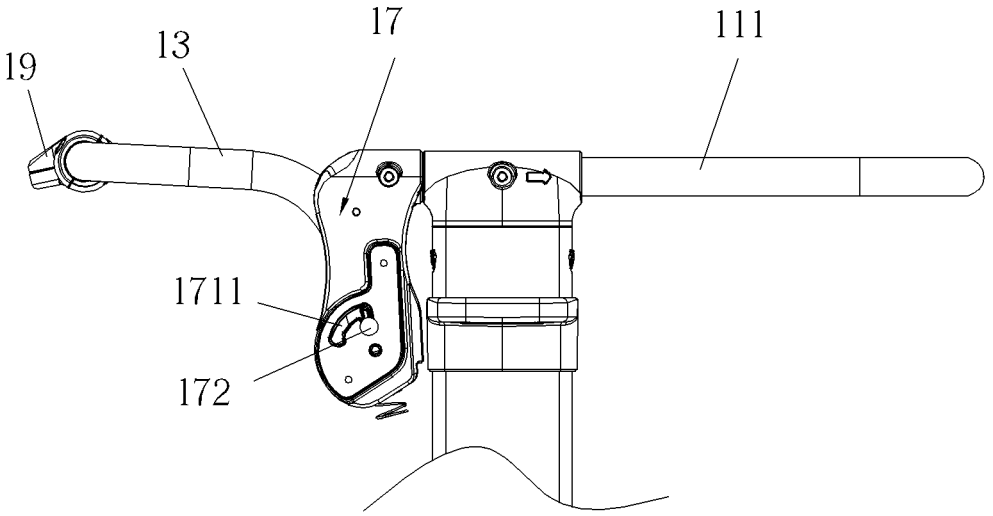
FIG. 3A is an enlarged side view of the child accommodating apparatus as shown in FIG. 1 according to the first embodiment of the present application.
Figure 3B:
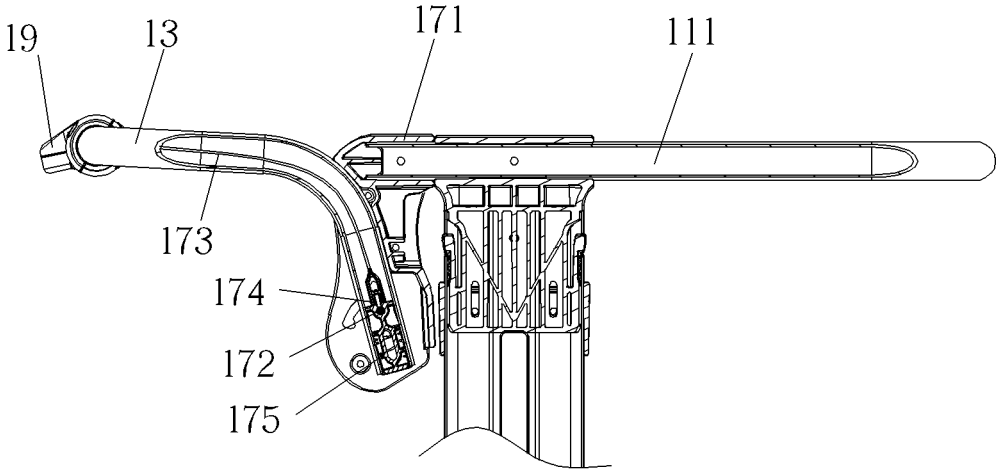
FIG. 3B is sectional diagram of the child accommodating apparatus as shown in FIG. 3A according to the first embodiment of the present application.
Figure 4:
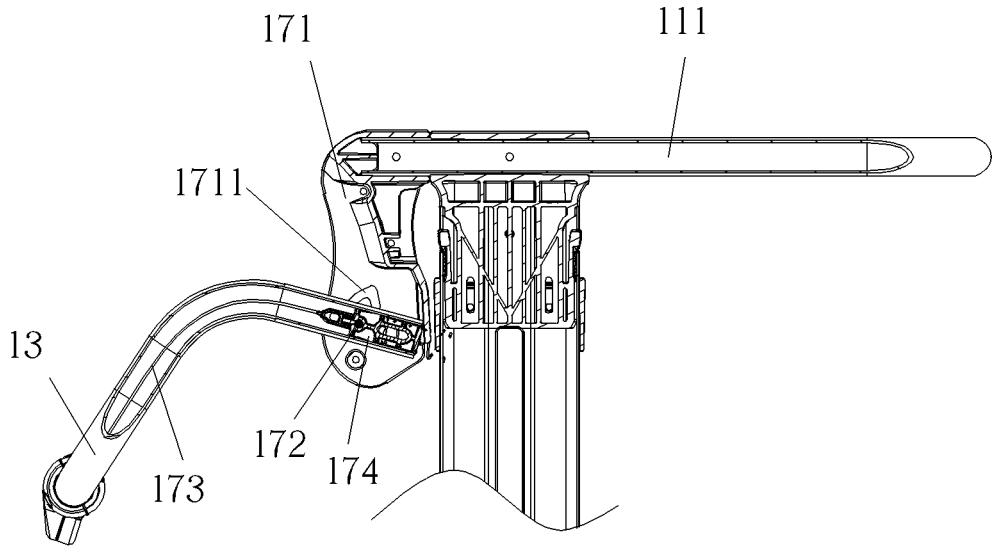
FIG. 4 is an enlarged sectional side view of the child accommodating apparatus as shown in FIG. 2 according to the first embodiment of the present application.

Please refer to FIG. 3A to FIG. 4. FIG. 3A is an enlarged side view of the child accommodating apparatus as shown in FIG. 1 according to the first embodiment of the present application. FIG. 3B is sectional diagram of the child accommodating apparatus as shown in FIG. 3A according to the first embodiment of the present application. FIG. 4 is an enlarged sectional side view of the child accommodating apparatus as shown in FIG. 2 according to the first embodiment of the present application. The armrest rotating mechanism includes an engagement device 17 and an operation device 19. The engagement device 17 is disposed between the armrest tube 13 and the frame 11 and for positioning the armrest tube 13 relative to the frame 11. The operation device 19 is disposed on the armrest tube 13. The operation device 19 can be operated to drive the engagement device 17 to disengage the armrest tube 13 from the frame 11 so that the armrest tube 13 can be rotated.

As shown in FIG. 3A to FIG. 4, the engagement device 17 includes a fixing holder 171, an engaging pin 172, and a transmission member 173. An end of the fixing holder 171 is fixed on the frame 11, such as being fixed on an upper tube 111 of the frame 11 by screw connection, and another end of the fixing holder 171 is pivoted to an end of the armrest tube 13. A positioning groove 1711 can be formed on the fixing holder 171 and includes a groove portion and a plurality of restraining portions positioned at terminal ends of the groove portion. As shown in FIG. 3A, the location where the engaging pin 172 is settled (and restrained) in the positioning groove 1711 corresponds to the restraining portion. Therefore, the engaging pin 172 engaged with the positioning groove can move in the groove portion and be restrained at one of the restraining portions. Besides, the engaging pin 172 is connected with the transmission member 173 and can penetrate through the armrest tube 13. An end of the transmission member 173 is connected to the operation device 19, and another end of the transmission member 173 is connected to the engaging pin 172 so as to provide transmission between the engaging pin 172 and the operation device 19. In addition, the transmission member 173 can be, but is not limited to, a steel cable.

According to a preferred embodiment, the positioning groove 1711 can be in a form of a curved channel, and two restraining portions positioned at two terminal ends of the groove portion can have forms of barb-shaped cavities to fully restrain the engaging pin 172. Preferably, the restraining portion of the positioning groove 1711 at the terminal end that corresponds to the using configuration of the armrest tube 13 can be in the form of the barb-shaped cavity, and the restraining portion at the terminal end that corresponds to the access configuration of the armrest tube 13 can be in a form of a shallow cavity that partially restrains the engaging pin 172 so as to provide a sense of restraint.

According to a preferred embodiment, the engagement device 17 can further include a sliding member 174 and a resilient member 175. The sliding member 174 is fixed on the engaging pin 172, and the resilient member 175 is disposed between the armrest tube 13 and the sliding member 174. An end of the transmission member 173 is connected to the operation device 19, and another end of the transmission member 173 is fixed on the sliding member 174 so that the engaging pin 172 can be driven through the driven sliding member 174. The resilient member 175 can be, but is not limited to, a spring and is for resiliently restoring the sliding member 174.

In practical application, the sliding member 174, the engaging pin 172, the resilient member 175 and the transmission member 173 are accommodated inside the armrest tube 13, and an end of the engaging pin 172 protrudes out of (or penetrates through) the armrest tube 13 so as to engage with the positioning groove 1711. When the operation device 19 is operated to pull the transmission member 173, the sliding member 174 and the engaging pin 172 are pulled upwards by the transmission member 173 so that the engaging pin 172 can be disengaged from the restraining portion of the positioning groove 1711. Therefore, when the armrest tube 13 is rotated downwards for adjustment, the engaging pin 172 can move in the groove portion of the positioning groove 1711 until the engaging pin 172 reaches the shallow cavity at the other terminal end of the positioning groove 1711, where the shallow cavity corresponds to the access configuration of the armrest tube 13 under a partial restraint. According to another embodiment, a restraining portion for full restraint (such as the abovementioned barb-shaped cavity) can be disposed at the other terminal end of the positioning grove 1711 instead of the shallow cavity for partial restraint, so the engaging pin 172 of the engagement device 17 needs to be driven to disengage from the restraining portion (being a barb-shaped cavity) of the positioning groove 1711 via additionally operating the operation device 19.

Figure 5:
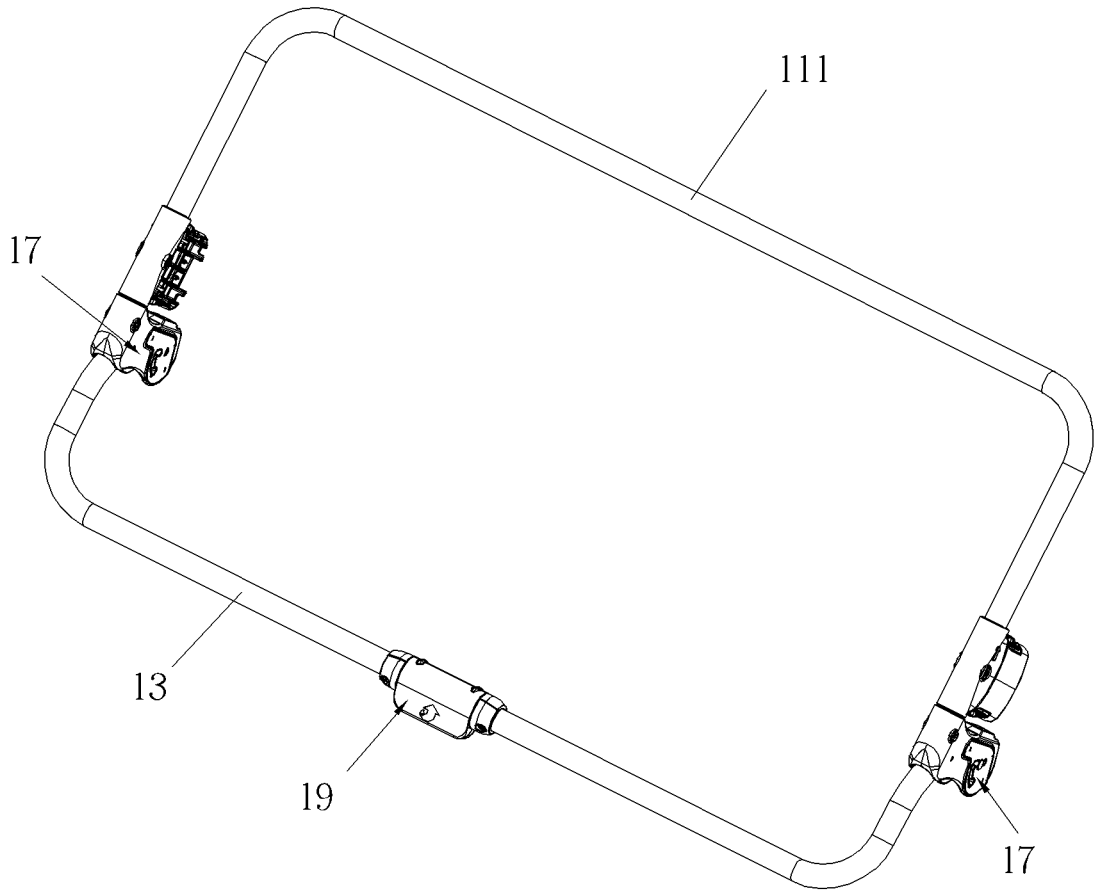
FIG. 5 is a schematic diagram of a partial structure of the child accommodating apparatus as shown in FIG. 1 according to the first embodiment of the present application.
Figure 6:
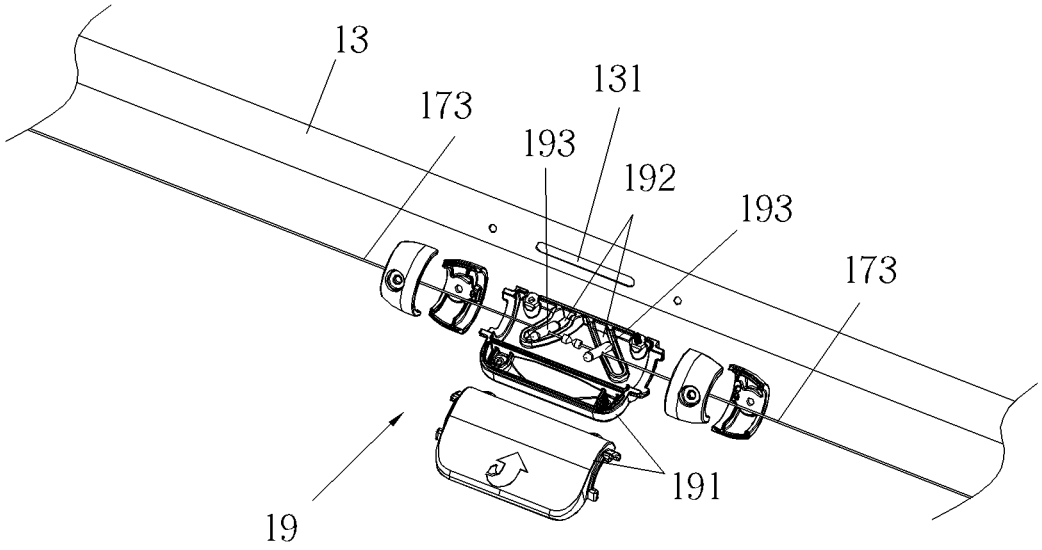
FIG. 6 is an exploded diagram of an operation device of the child accommodating apparatus as shown in FIG. 5 according to the first embodiment of the present application.

Please refer to FIG. 4, FIG. 5 and FIG. 6. FIG. 5 is a schematic diagram of a partial structure of the child accommodating apparatus as shown in FIG. 1 according to the first embodiment of the present application. FIG. 6 is an exploded diagram of an operation device 19 of the child accommodating apparatus as shown in FIG. 5 according to the first embodiment of the present application. As shown in FIG. 5, the engagement devices 17 are disposed at terminal ends of the lateral arms of the armrest tube 13, and the operation device 19 is disposed on the front portion of the armrest tube 13 for easy operation. As shown in FIG. 6, according to the embodiment, the operation device 19 includes a housing 191, driving grooves 192, and inserting pins 193. The housing 191 is rotatably installed on the armrest tube 13. The driving grooves 192 are disposed on the housing 191. The inserting pins 193 are engaged with the driving grooves 192 and connected with the transmission members 173. When the housing 191 is rotated, the driving grooves 192 on the housing 191 guide the inserting pins 193 to move, such as moving along a horizontal direction, so as to drive the transmission members 173 connected with the inserting pins 193.

In practical application, the housing 191 is pivoted to the armrest tube 13. An extension direction of the driving groove 192 is inclined relative to a horizontal direction, and an extension direction of the inserting pin 193 is substantially perpendicular to a plane whereon the driving groove 192 is located. Specifically, a longitudinal opening 131 is formed on the armrest tube 13 along a longitudinal direction of the armrest tube 13, and the inserting pins 193 pass through the longitudinal opening 131. An end of the inserting pin 193 abuts against a bottom portion of the driving groove 192, and another end of the inserting pin 193 abuts an inner wall of the housing 191 or a driving groove on the inner wall.

According to a preferred embodiment, the two driving grooves 192 are extended along directions gradually divergent from each other, and the two inserting pins 193 are respectively engaged with the two driving grooves 192. When the housing 191 is rotated, such as being rotated upwards or downwards, the driving grooves 192 are driven to move upwards or downwards, which drives (or guides) the inserting pins 193 to move horizontally, such as moving leftwards or rightwards, so as to pull the transmission members 173 (such as steel cables) for controlling engagement configuration of the engagement devices 17 on the two lateral arms of the armrest tube 13. Specifically, after the tightly pulled steel cable 173 pulls the sliding member 174 to drive the engaging pin 172 to disengage from the restraining portion of the positioning groove 1711, the armrest tube 13 can be rotated for adjustment. After the rotation of the armrest tube 13 is finished, the operation device 19 can be released since the armrest tube 13 has been settled as fixed by the engagement device 17.

Figure 7:
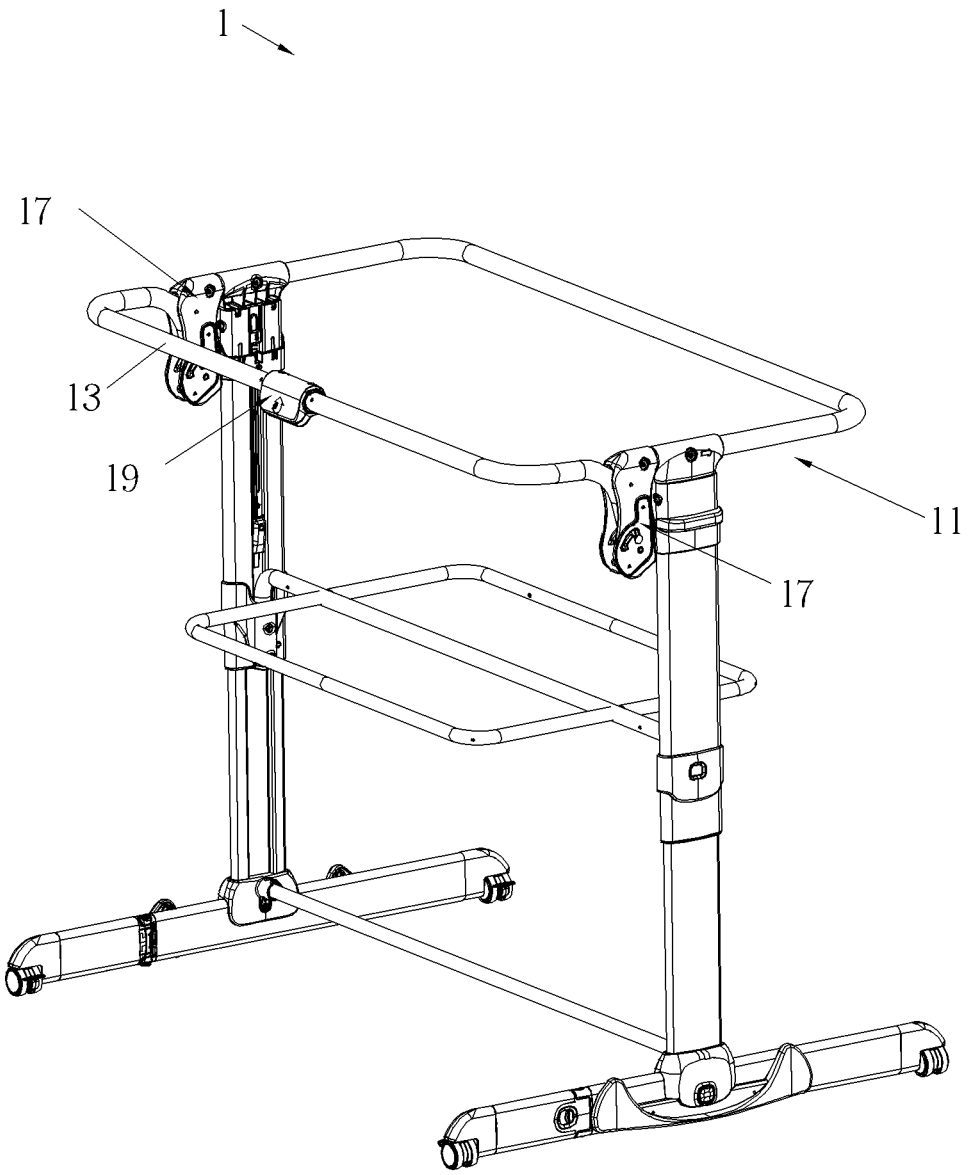
FIG. 7 is a diagram of the child accommodating apparatus at a using configuration according to a second embodiment of the present application.
Figure 8:
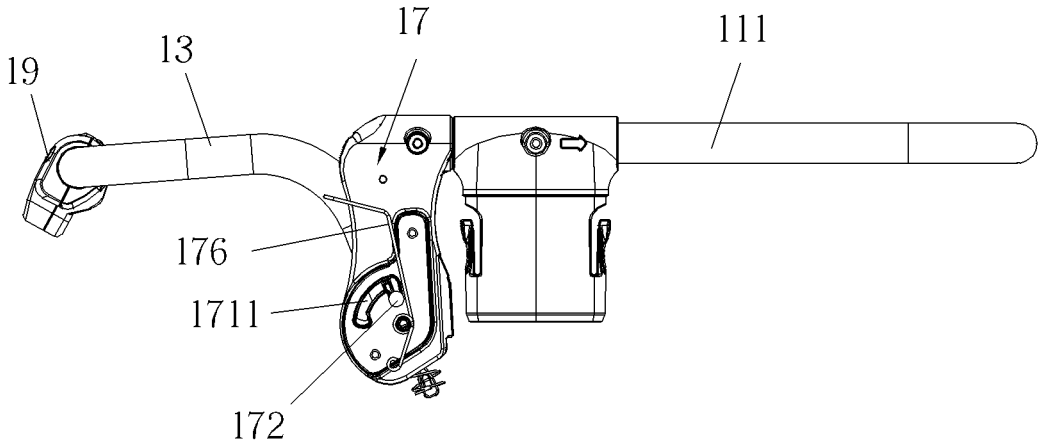
FIG. 8 is an enlarged side view of the child accommodating apparatus as shown in FIG. 7 according to the second embodiment of the present application.
Figure 9:
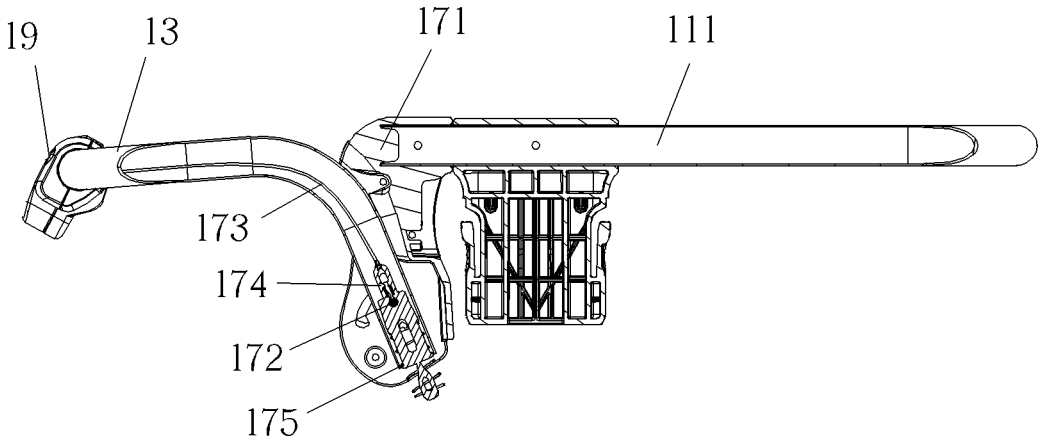
FIG. 9 is a sectional diagram of the child accommodating apparatus as shown in FIG. 8 according to the second embodiment of the present application.

Please refer to FIG. 7 to FIG. 9. FIG. 7 is a diagram of the child accommodating apparatus at a using configuration according to a second embodiment of the present application. FIG. 8 is an enlarged side view of the child accommodating apparatus as shown in FIG. 7 according to the second embodiment of the present application. FIG. 9 is a sectional diagram of the child accommodating apparatus as shown in FIG. 8 according to the second embodiment of the present application. The main difference between this second embodiment and the previous first embodiment is the structural design of the engagement device 17. For simplicity, components in this second embodiment having the same functions as ones illustrated in the first are provided with the same item numbers, and description related to the corresponding components will not be reiterated.

As shown in FIG. 8, according to the second embodiment, the engagement device 17 can further include a restoring member 176 for restoring the armrest tube 13. The restoring member 176 can be, but is not limited to, a torsion spring installed on the fixing holder 171. An end of the restoring member 176 abuts against an erect wall of the fixing holder 171, and another end of the restoring member 176 abuts against the armrest tube 13, such as abutting against a cavity on an inner wall of the armrest tube 13. After the downward rotation of the biased armrest tube 13 is finished, the restoring member 176 (such as the torsion spring) can automatically restore the armrest tube 13 when the armrest tube 13 is released. According to another embodiment, the restored armrest tube 13 can be set as locked in correspondence to the operation device 19 settled at the using configuration.

Figure 10:
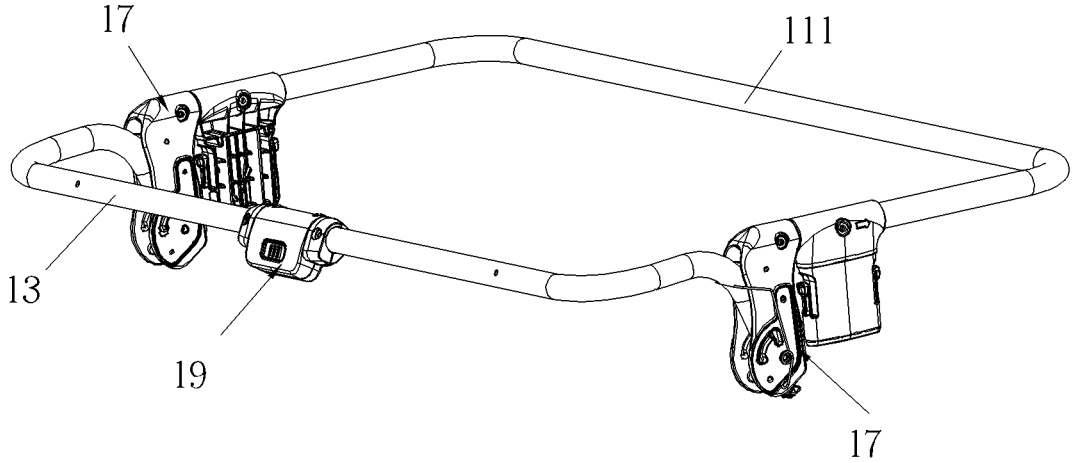
FIG. 10 is a schematic diagram of a partial structure of the child accommodating apparatus according to a third embodiment of the present application.
Figure 11:
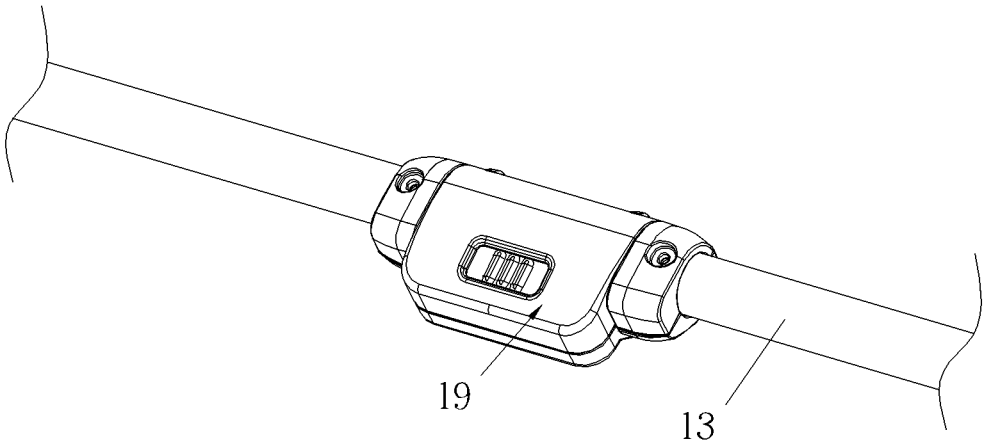
FIG. 11 is an enlarged view of an operation device of the child accommodating apparatus as shown in FIG. 10 according to the third embodiment of the present application.
Figure 12:
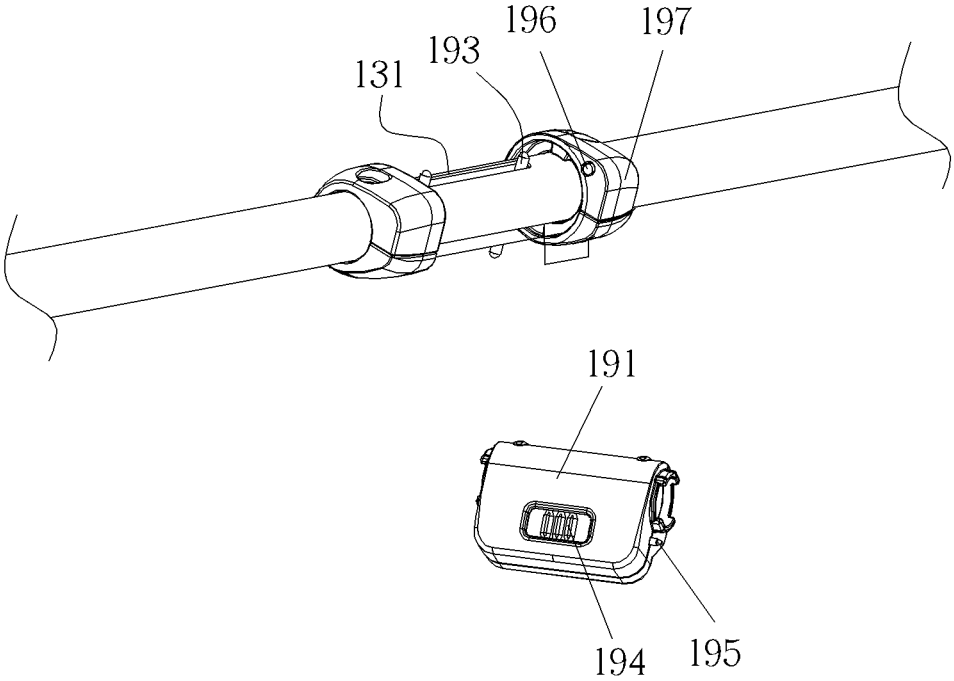
FIG. 12 is an exploded diagram of the operation device as shown in FIG. 11 according to the third embodiment of the present application.
Figure 13:
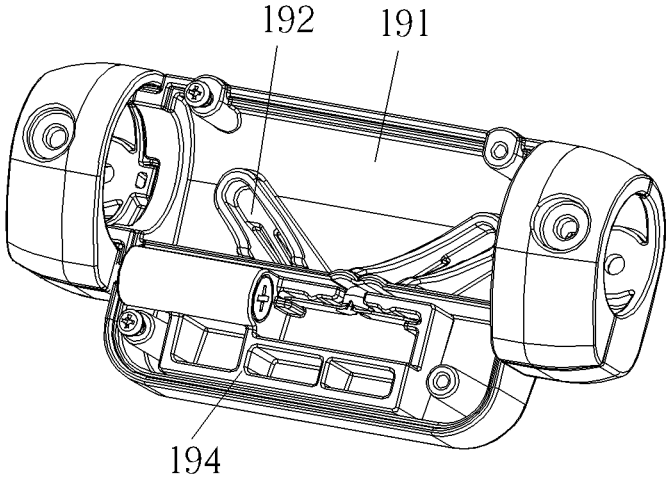
FIG. 13 is a diagram of the operation device as shown in FIG. 12 at an opened configuration according to the third embodiment of the present application.
Figure 14:
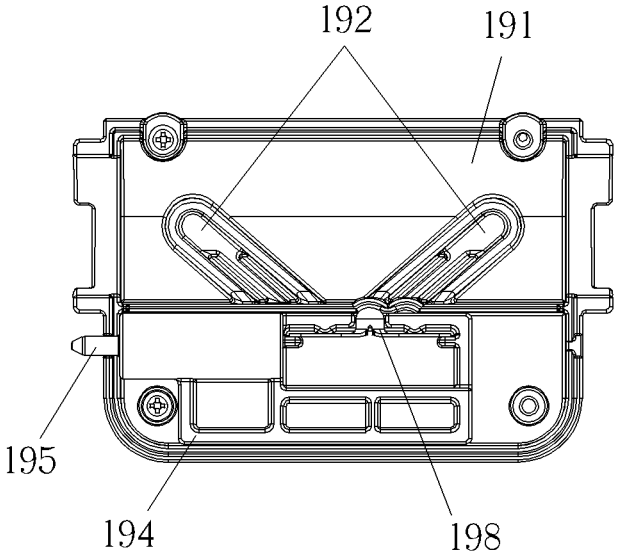
FIG. 14 is a top view of the operation device as shown in FIG. 13 according to the third embodiment of the present application.

Please refer to FIG. 4 and FIG. 10 to FIG. 14. FIG. 10 is a schematic diagram of a partial structure of the child accommodating apparatus according to a third embodiment of the present application. FIG. 11 is an enlarged view of the operation device 19 of the child accommodating apparatus as shown in FIG. 10 according to the third embodiment of the present application. FIG. 12 is an exploded diagram of the operation device 19 as shown in FIG. 11 according to the third embodiment of the present application. FIG. 13 is a diagram of the operation device 19 as shown in FIG. 12 at an opened configuration according to the third embodiment of the present application. FIG. 14 is a top view of the operation device 19 as shown in FIG. 13 according to the third embodiment of the present application. The main difference between this third embodiment and the first embodiment is the structural design of the operation device 19. According to this third embodiment, the restraining portion of the positioning groove 1711 at the terminal end that corresponds to the using configuration of the armrest tube 13 is in the form of the barb-shaped cavity, and the restraining portion at the terminal end that corresponds to the access configuration of the armrest tube 13 is in a form of a shallow cavity that partially restrains the engaging pin 172 so as to provide a sense of restraint.

As shown in FIG. 12 to FIG. 14, according to the third embodiment, the operation device 19 can have a function of positioning. In addition to the housing 191, the driving grooves 192 and the inserting pins 193 of the first embodiment, the operation device 19 can further include a button body 194, a locking pin 195, and a positioning hole 196. The button body 194 is left and right movably accommodated in the housing 191 and partially exposed outside the housing 191. The locking pin 195 is connected with the button body 194. The positioning hole 196 is positioned on a side of the housing 191, and the locking pin 195 is configured to protrude out of the housing 191 so as to engage with the positioning hole 196. Besides, a leaf spring 198 can further be installed inside the button body 194 and provide the button body 194 with a sense of restraint when the button body moves left and right between left and right configurations. In addition, an installation holder 197 can be disposed on the armrest tube 13 and on a side of the housing 191 so that the positioning hole 196 can be configured and formed at a location on the installation holder 197 where the positioning hole 196 can engage with the locking pin 195.

According to an embodiment, the armrest tube 13 can be kept unlocked at the using configuration after being restored from the rotational operation, which requires the locking configuration of the driving grooves 192 and the inserting pins 193 inside the operation device 19. For example, after the transmission member 173 is pulled by the rotated housing 191 so as to drive the engagement device 17 to disengage, the button body 194 can be moved towards the positioning hole 196 so that the locking pin 195 can be inserted into the positioning hole 196 for locking the rotated housing 191 at a configuration corresponding to the disengagement of the engagement device 17. Since the engagement device 17 is disengaged, the armrest tube 13 can be rotated downwards. After the downward rotation of the armrest tube 13 is finished, the armrest tube 13 can be released for being restored automatically by the restoring member 176. Since the abovementioned configuration between the driving grooves 192 and the inserting pins 193 inside the operation device 19 has been locked, the restored armrest tube 13 can be kept unlocked instead of being locked by a restraint from the restraining portion of the positioning groove 1711.

According to another embodiment, the armrest tube 13 can be kept locked at the using configuration after being restored from the rotational operation. For example, after the transmission member 173 is pulled by the rotated housing 191 so as to drive the engagement device 17 to disengage, the button body 194 is kept to stay so that the locking pin 195 is not to be inserted into the positioning hole 196, so the rotated housing 191 is not to be locked at the configuration corresponding to the disengagement of the engagement device 17. Since the engagement device 17 is disengaged, the armrest tube 13 can be rotated downwards. After the downward rotation of the armrest tube 13 is finished, the armrest tube 13 can be released for being restored automatically by the restoring member 176. When the armrest tube 13 is restored to the using configuration, the resilient member 175 restores the sliding member 174 to drive the engaging pin 172 to engage with the restraining portion of the positioning groove 1711, which not only locks the armrest tube 13 at the using configuration but also restores the rotated housing 191 by correspondingly shifting the configurations between the inserting pins 193 and the driving grooves 192 via the transmission member 173 connected with the sliding member 174.

Figure 15:
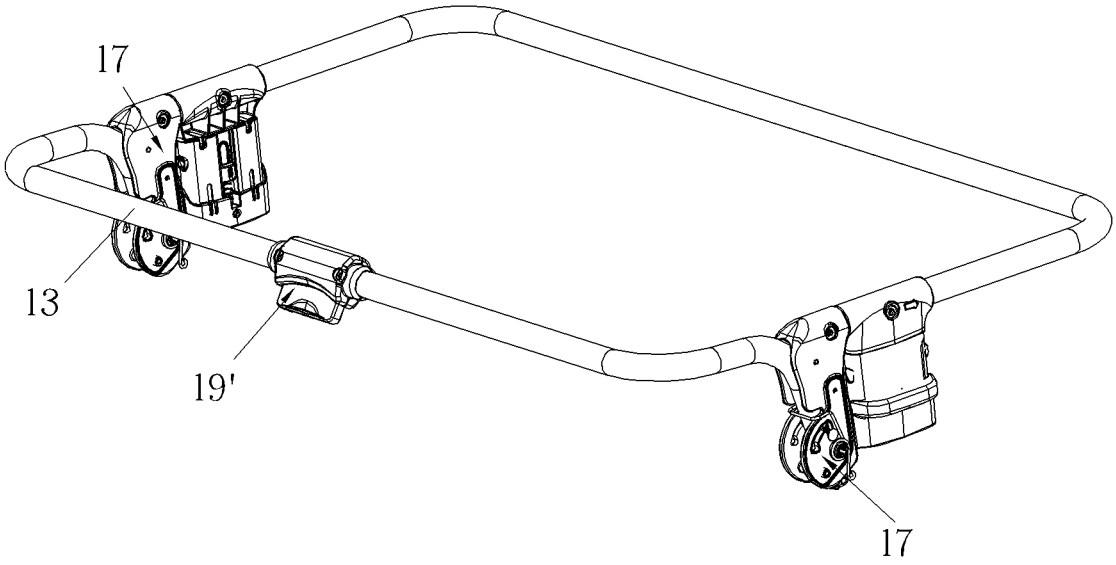
FIG. 15 is a schematic diagram of a partial structure of the child accommodating apparatus according to a fourth embodiment of the present application.
Figure 16:
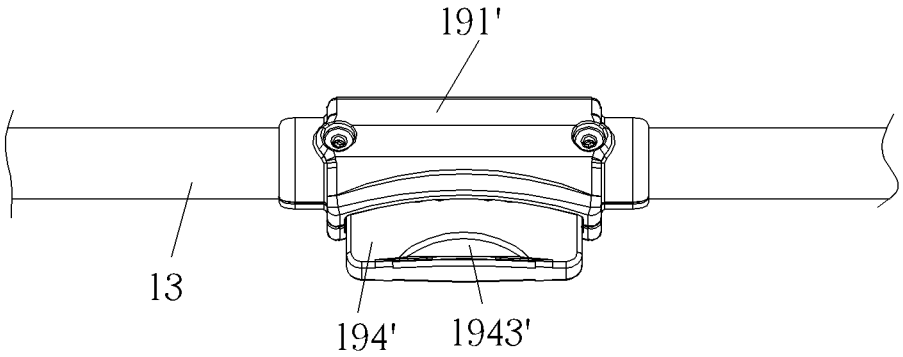
FIG. 16 is an enlarged view of an operation device of the child accommodating apparatus as shown in FIG. 15 according to the fourth embodiment of the present application.
Figure 17:
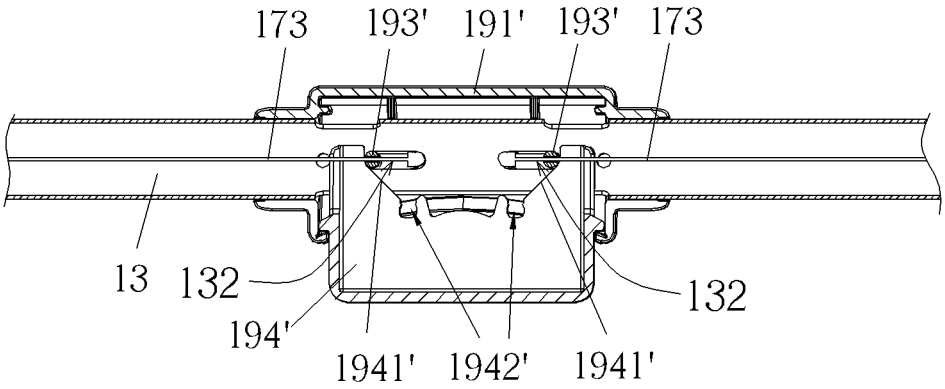
FIG. 17 is a sectional diagram of the operation device as shown in FIG. 16 according to the fourth embodiment of the present application.
Figure 18:
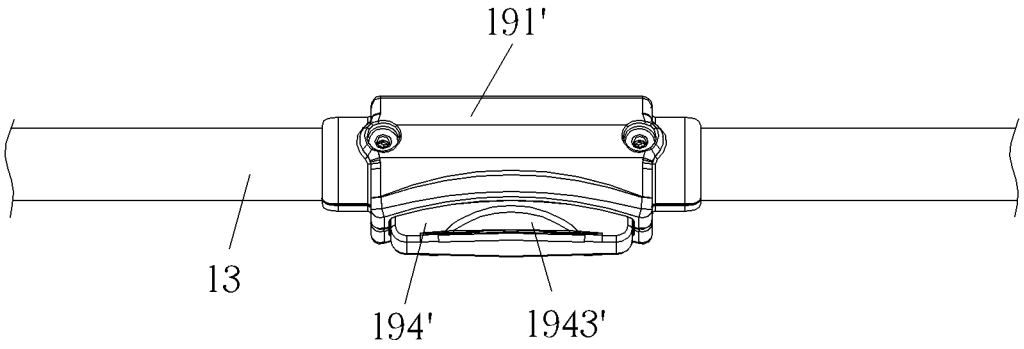
FIG. 18 is a diagram of the operation device as shown in FIG. 16 with a pressed button body according to the fourth embodiment of the present application.
Figure 19:
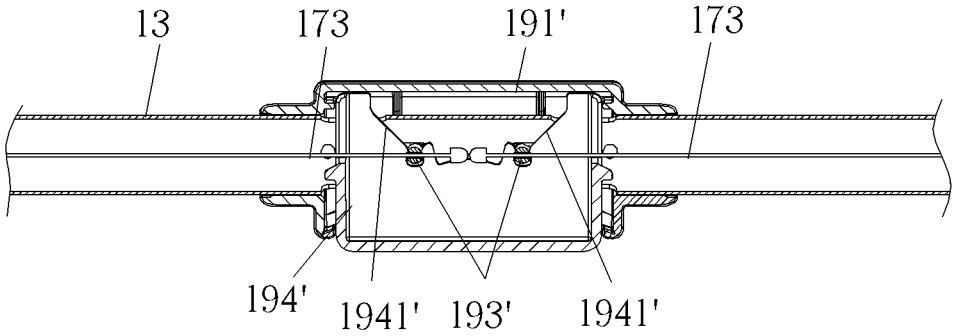
FIG. 19 is a sectional diagram of the operation device as shown in FIG. 18 according to the fourth embodiment of the present application.

Please refer to FIG. 15 to FIG. 19. FIG. 15 is a schematic diagram of a partial structure of the child accommodating apparatus according to a fourth embodiment of the present application. FIG. 16 is an enlarged view of an operation device 19' of the child accommodating apparatus as shown in FIG. 15 according to the fourth embodiment of the present application. FIG. 17 is a sectional diagram of the operation device 19' as shown in FIG. 16 according to the fourth embodiment of the present application. FIG. 18 is a diagram of the operation device 19' as shown in FIG. 16 with a pressed button body 194' according to the fourth embodiment of the present application. FIG. 19 is a sectional diagram of the operation device 19' as shown in FIG. 18 according to the fourth embodiment of the present application. The main difference between this fourth embodiment and the previous first embodiment is the structural design of the operation device 19'. According to the fourth embodiment, the operation device 19' includes a housing 191', a button body 194', and inserting pins 193'. The housing 191' is fixed on the armrest tube 13. The button body 194' is up and down movably installed on the housing 191' and the armrest tube 13. The inserting pins 193' are configured to be selectively engaged with the button body 194'. Specifically, the housing 191' can be installed on the armrest tube 13 by screw connection, and the inserting pins 193' can be connected with the transmission members 173 and the arm rest tube 13. According to a preferred embodiment, sliding grooves 132 can further be formed on the armrest tube 13, and the inserting pins 193' can be vertically disposed in the sliding grooves 132 and driven by the transmission members 173 so as to move left and right along the sliding grooves 132.

Please refer to FIG. 17 and FIG. 19. The inclined surfaces 1941' interfering with the inserting pin 193' can be disposed on the button body 194', and a restraining groove 1942' can be positioned at a terminal end of each of the inclined surfaces 1941'. When the button body 194' moves, the inserting pin 193' can move along a locking direction relative to the inclined surface 1941' towards the restraining groove 1942' so as to be inserted into the restraining groove 1942' for achieving a locking status where the button body 194' is locked. At the locking status, the engagement device 17 is disengaged so that the armrest tube 13 can be freely rotated up and down. Specifically, the button body 194' installed on the armrest tube 13 faces downwards, that is, the button body 194' can move up and down relative to the armrest tube 13. According to the fourth embodiment, when the button body 194' is upwardly pushed to move along an unlocking direction, the inclined surface 1941' drives (and guides) the inserting pin 193' to move into the restraining groove 1942' for achieving an unlocking status, but not limited to this. When the inserting pin 193' is inserted in the restraining groove 1942', an upper end of the button body 194' abuts against an inner wall of the housing 191'.

According to a preferred embodiment, as shown in FIG. 16 and FIG. 18, an end portion of the button body 194' is exposed outside the housing 191', and an operation portion 1943' is disposed on the end portion. The operation portion 1943' can be a handgrip where fingers can grip to pull down the button body 194' along a locking direction so that the inserting pin 193' can be disengaged from the restraining groove 1942'. After the inserting pin 193' is disengaged from the restraining groove 1942', the inserting pin 193' and the transmission member 173 can be restored to engage the engagement device 17 for locking the armrest tube 13.

In conclusion, the armrest rotating mechanism is suitable for the child accommodating apparatus with an armrest. By operating the operation device on the armrest tube to drive the engagement device, the armrest tube can be disengaged from the frame, which enables the configuration of the armrest tube to be adjusted relative to the frame. That is, the armrest tube can be rotated from the lifted using configuration to the lowered access configuration that is opened for easy access. In addition, the armrest rotating mechanism has the advantages of simple structure, a reliable locking design, and an easy unlocking design and can be applied to various fields.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child accommodating apparatus comprising:
a frame;
an armrest tube rotatably connected with the frame; and
an armrest rotating mechanism for rotating the armrest tube, the armrest rotating mechanism comprising:
an engagement device disposed between the armrest tube and the frame and for positioning the armrest tube relative to the frame; and
an operation device disposed on the armrest tube and connected with the engagement device, the operation device comprising:
a housing rotatably installed on the armrest tube and rotatable relative to the armrest tube;
a driving groove disposed on the housing; and
an inserting pin engaged with the driving groove and coupled to the engagement device;
wherein when the housing of the operation device is operated to rotate relative to the armrest tube, the inserting pin is driven by the driving groove to drive the engagement device to disengage the armrest tube from the frame and an extension direction of the driving groove is inclined relative to a moving direction of the inserting pin.

2. The child accommodating apparatus of claim 1, wherein the engagement device comprises:
a fixing holder fixed on the frame, a positioning groove being formed on the fixing holder, and the armrest tube being pivoted to the fixing holder;
an engaging pin engaged with the positioning groove; and
a transmission member connected to the engaging pin and the inserting pin of the operation device;
wherein the housing of the operation device is operated to rotate relative to the armrest tube to drive the inserting pin to drive the transmission member to disengage the engaging pin from the positioning groove.

3. The child accommodating apparatus of claim 2, wherein the engagement device further comprises:
a sliding member fixed on the engaging pin; and
a resilient member disposed between the armrest tube and the sliding member, the transmission member being connected to the sliding member and the inserting pin of the operation device.

4. The child accommodating apparatus of claim 2, wherein the positioning groove comprises:
a groove portion; and
a plurality of restraining portions positioned at two terminal ends of the groove portion, the engaging pin being configured to move in the groove portion and to be restrained at one of the plurality of restraining portions.

5. The child accommodating apparatus of claim 2, wherein the engagement device further comprises:
a restoring member installed on the fixing holder, an end of the restoring member abutting against the fixing holder, and another end of the restoring member abutting against the armrest tube.

6. The child accommodating apparatus of claim 1, wherein an end of the inserting pin abuts against the driving groove.

7. The child accommodating apparatus of claim 1, wherein the extension direction of the driving groove is inclined relative to a horizontal direction, and an extension direction of the inserting pin is substantially perpendicular to a plane whereon the driving groove is located.

8. The child accommodating apparatus of claim 1, wherein the operation device further comprises:
a button body left and right movably accommodated in the housing and partially exposed outside the housing;
a locking pin connected with the button body; and
a positioning hole positioned on a side of the housing, the locking pin being configured to protrude out of the housing so as to engage with the positioning hole.

9. The child accommodating apparatus of claim 8, further comprising a leaf spring installed inside the button body.

10. A child accommodating apparatus comprising:
a frame;
an armrest tube rotatably connected with the frame; and
an armrest rotating mechanism for rotating the armrest tube, the armrest rotating mechanism comprising:
an engagement device disposed between the armrest tube and the frame and for positioning the armrest tube relative to the frame; and
an operation device disposed on the armrest tube and connected with the engagement device, the operation device comprising:
a housing fixed on the armrest tube;
a button body up and down movably installed on the housing and the armrest tube; and
an inserting pin selectively engaged with the button body and coupled to the engagement device, a moving direction of button body being different from a moving direction of the inserting pin;
wherein the button body of the operation device is operated to move relative to the armrest tube to drive the inserting pin to drive the engagement device to disengage the armrest tube from the frame, an inclined surface interfering with the inserting pin is disposed on the button body, and the inclined surface is inclined relative to the moving direction of the button body and the moving direction of the inserting pin.

11. The child accommodating apparatus of claim 10, wherein the engagement device comprises:
a fixing holder fixed on the frame, a positioning groove being formed on the fixing holder, and the armrest tube being pivoted to the fixing holder;
an engaging pin engaged with the positioning groove; and
a transmission member connected to the engaging pin and the inserting pin of the operation device;
wherein the button body of the operation device is operated to move relative to the armrest tube to drive the inserting pin to drive the transmission member to disengage the engaging pin from the positioning groove.

12. The child accommodating apparatus of claim 11, wherein the engagement device further comprises:
a sliding member fixed on the engaging pin; and
a resilient member disposed between the armrest tube and the sliding member, the transmission member being connected to the sliding member and the inserting pin of the operation device.

13. The child accommodating apparatus of claim 11, wherein the positioning groove comprises:
a groove portion; and
a plurality of restraining portions positioned at two terminal ends of the groove portion, the engaging pin being configured to move in the groove portion and to be restrained at one of the plurality of restraining portions.

14. The child accommodating apparatus of claim 11, wherein the engagement device further comprises:

a restoring member installed on the fixing holder, an end of the restoring member abutting against the fixing holder, and another end of the restoring member abutting against the armrest tube.

15. The child accommodating apparatus of claim 10, wherein a sliding groove is formed on the armrest tube, and the inserting pin is movably disposed in the sliding groove.

16. The child accommodating apparatus of claim 10, wherein a restraining groove is positioned at a terminal end of the inclined surface, and the inserting pin is configured to move along an unlocking direction relative to the inclined surface towards the restraining groove so as to be inserted into the restraining groove for achieving an unlocking status.

17. The child accommodating apparatus of claim 10, wherein the button body comprises an operation portion exposed outside the housing and for pulling the button body along a locking direction.

* * * * *